US007399209B2

(12) United States Patent
Kodaira

(10) Patent No.: US 7,399,209 B2
(45) Date of Patent: Jul. 15, 2008

(54) COAXIAL CABLE WITH PLUG

(75) Inventor: Makoto Kodaira, Tokyo (JP)

(73) Assignee: Uro Denshi Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/517,302

(22) PCT Filed: Jun. 12, 2003

(86) PCT No.: PCT/JP03/07506

§ 371 (c)(1),
(2), (4) Date: May 27, 2005

(87) PCT Pub. No.: WO03/107491

PCT Pub. Date: Dec. 24, 2003

(65) Prior Publication Data

US 2005/0221669 A1 Oct. 6, 2005

(30) Foreign Application Priority Data

Jun. 12, 2002 (JP) ..... 2002-171532

(51) Int. Cl.
*H01R 25/00* (2006.01)

(52) U.S. Cl. ..... 439/640; 439/31; 439/165; 439/446

(58) Field of Classification Search ..... 439/31, 439/640, 446, 165, 611, 13, 20, 578, 582
See application file for complete search history.

(56) References Cited

U.S. PATENT DOCUMENTS 5,419,707 A * 5/1995 Kelley ..... 439/21
5,681,171 A * 10/1997 Park ..... 439/31
5,882,226 A * 3/1999 Bell et al. ..... 439/582
6,695,620 B1 * 2/2004 Huang ..... 439/11
6,817,899 B1 * 11/2004 Zerebilov ..... 439/582
7,175,466 B2 * 2/2007 Feinweber et al. ..... 439/357
7,207,844 B2 * 4/2007 Peng ..... 439/640

FOREIGN PATENT DOCUMENTS

JP 58-73584 5/1983
JP 2002-170638 A 6/2002
JP 5-94974 12/2003

* cited by examiner

*Primary Examiner*—Truc T. T. Nguyen
*Assistant Examiner*—X. Chung-Trans
(74) *Attorney, Agent, or Firm*—Mattingly, Stanger, Malur & Brundidge, P.C.

(57) ABSTRACT

A coaxial cable with a Plug comprises a coaxial cable (1) in which an outer conductor (103) is provided around a center conductor (101) with an insulator (102) interposed therebetween and a plug (2) having a center contact (201) electrically connected to the center conductor (101) via a center conductor connecting member (203) and an outer contact (202) electrically connected to the outer conductor (103) via an outer conductor connecting member (204). The center contact (201) and the outer contact (202) rotate about an axis (RX) perpendicular to the axis (201X) of the center contact while maintaining the electrical connection between the center contact (201) and the center conductor (101) and the electrical connection between the outer contact (202) and the outer conductor (103).

3 Claims, 21 Drawing Sheets

(a)

(b)

(a)

(b)

(a)

(b)

COAXIAL CABLE WITH PLUG

TECHNICAL FIELD

The present invention relates to a coaxial cable with a plug, and in particular, it relates to a technology, which is effective when applied to a coaxial cable with a plug connected to a television antenna and a receiver.

BACKGROUND ART

Heretofore, in general, for a data transfer cable, there has been known a coaxial cable provided with an external conductor, for example, such as a netted copper wire allowing an insulator to intervene around a copper core wire (herein after referred to as a central conductor). At this time, the external conductor is cylindrically provided around the central conductor, and has an advantage of shutting off a noise. Hence, the coaxial cable is widely used as a cable of transferring a high frequency signal such as a television signal.

Further, when the coaxial cable is connected to the television antenna and receiver, the coaxial cable with a plug is used, which is provided with a plug having a central contact electrically connected to the central conductor of the coaxial cable and an external contact electrically connected to the external conductor. At this time, in the coaxial cable with a plug, as shown in FIG. 21(*a*), there are a straight type in which the axial direction 201X of the central contact 201 and the pulling direction 1X of the coaxial cable 1 are in parallel, and as shown in FIG. 21(*b*), a right angle type in which the axial direction 201X of the central contact 201 and the pulling direction 1X of the coaxial cable 1 make a right angle.

In the case of the coaxial cable with a plug of the straight type, for example, when it is connected to a receiving terminal of the television located at a wall surface at home and the like, a bulging out from the wall surface of the coaxial cable 1 becomes large. Hence, the bulged portion catches legs and the like, thereby causing a high risk of falling down or the cable being pulled out. Further, in case the receiving terminal of the television is, for example, located at the backside of furniture, a space in consideration of the bulged portion of the coaxial cable 1 has to be secured since the coaxial cable is severed when applied with an unnatural force and bent.

In the meantime, in the case of the coaxial cable with a plug of the right angle type, since the axial direction 201X of the central contact 201 and the pulling direction 1X of the coaxial cable 1 makes a right angle, when connected to the wall surface, the bulge of the coaxial cable 1 is small, so that a narrow space behind furniture and the like does not cause hindrance.

However, in such a coaxial cable with a plug, since the positional relation between the axial direction 201X of the central contact 201 and the pulling direction 1X of the coaxial cable 1 is fixed, either of the straight type or the right angle type has to be selected according to an application and a usage place. Hence, for example, due to a housing-moving and a change of design, the situation where, for example, the straight type coaxial cable with a plug becomes difficult to use occurs, the coaxial cable with a plug of the right angle type has to be newly purchased. That is, in the conventional coaxial cable with a plug, there has been a problem that a degree of freedom of adaptability to the application and the usage place is low.

Consequently, an object of the present invention is to provide a coaxial cable with a plug, which has no such a defect of the coaxial cable with a plug and is high in a degree of freedom of adaptability to the application and the usage place.

DISCLOSURE OF THE INVENTION

The present invention provides a coaxial cable with a plug, comprising an external conductor allowing an insulator to intervene around a central conductor, and a plug comprising the central contact electrically connected to the central conductor and the external contact electrically connected to the external conductor wherein the central contact and the external contact rotate with an axis in a direction orthogonal to the axial direction of the central conductor as a rotational axis while maintaining respective electrical connections with the central contact and the central conductor and the external contact and the external conductor. By the rotation of the contact portion and depending on an application and a usage place, for example, the coaxial cable can be used either in state where the axial direction of the central contact and the pulling direction of the cable are in parallel or in state where the axial direction of the central contact and the pulling direction of the cable make a right angle. Further, by rotating while maintaining the electrical connections, regardless of the state where the axial direction of the central contact and the pulling direction of the cable are in parallel or the state where the axial direction of the central contact and the pulling direction of the cable make a right angle, when the contact portion is in a rotatable range, the coaxial cable can be used with a flexible angle. Hence, comparing to the conventional coaxial cable with a plug, a degree of freedom of adaptability to the application and the usage place can be enhanced.

Further, the present invention in a coaxial cable with a plug, comprising an external conductor allowing an insulator to intervene around a central conductor, and a plug comprising the central contact electrically connected to the central conductor and the external contact electrically connected to the external conductor wherein the plug comprises the contact portion, and a main body unit comprising a central conductor connecting member electrically connecting the central contact and the central conductor, an external conductor connecting member connecting the external conduct and the external conductor, and an insulating member electrically insulating the central conductor connecting member and the external conductor connecting member, and the contact portion rotates with a axis in a direction orthogonal to the axial direction of the central conduct as a rotational axis while maintaining electrical connections with the central contact and the central conductor connecting member and electrical connections with the external contact and the external conductor connecting member, respectively. In this way, according to the application and the usage place, the coaxial cable can be used with a flexible angle, for example, in such a state in which the axial direction of the central contact and the pulling direction of the cable are in parallel or a state in which the axial direction of the central contact and the pulling direction of the cable make a right angle or the like. Hence, comparing to the conventional coaxial cable with a plug, a degree of freedom of adaptability to the application and the usage place can be enhanced.

Further, the present invention comprises a pair of protrusions to become a point of support for rotation at one end of the cylindrical conductor portion of the external contact of the coaxial cable with a plug, and moreover, an opening is made from the one protrusion so as to communicate with an inner space of the cylindrical conductor portion, and the central contact has a connecting portion with the central conductor connecting member on the rotational axis, and is bent in a direction to the protrusion provided with the opening portion from the central axis of the external contact. In this way, the coaxial cable can be rotated while maintaining the electrical connections with the central contact and the central conductor connecting member and electrical connections with the external conduct and the external conductor connecting member.

Further, the present invention has the external conductor connecting member of the coaxial cable with a plug comprises a plurality of conductor parts, and has the protrusion of the external contact nipped and support-fixed by the plurality of conductor parts. Further, at this time, the insulating member of the main body unit of the plug is provided in such a way that the central conductor connecting member and the external conductor connection member maintain a coaxial structure, so that the change of the impedance of the signal to be transferred can be avoided.

BEST MODE FOR CARRYING OUT THE INVENTION

Figure 1:
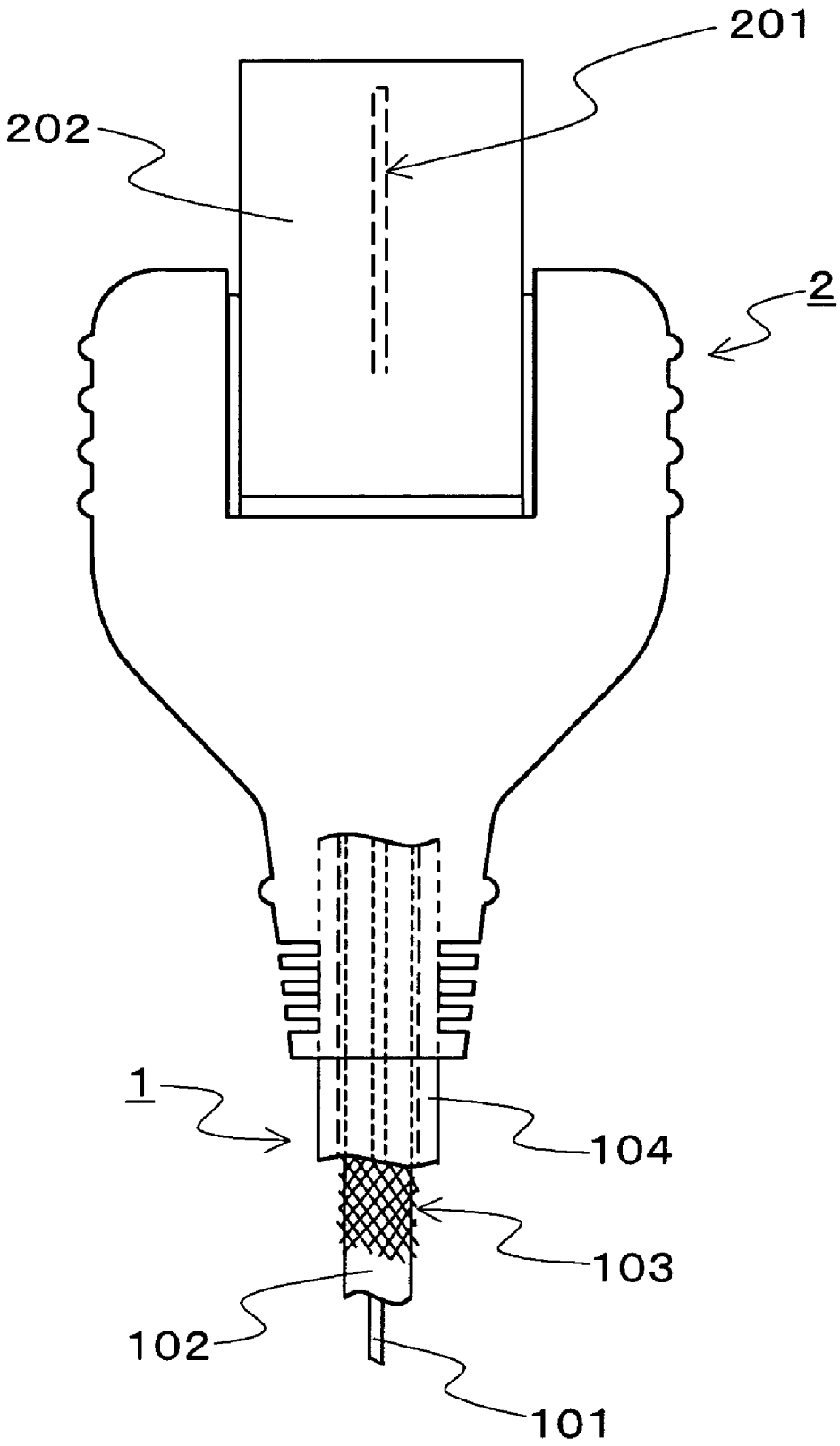
FIG. 1 is a schematic illustration showing a general structure of a coaxial cable with a plug of a first embodiment according to the present invention.

The present invention will be described more in detail below with reference to the accompanying drawings.

In all the drawings to explain the embodiments, those parts having the same functions will be attached with the same reference numerals, and the description thereof will be omitted.

The present invention in a coaxial cable with a plug, comprising an external conductor allowing an insulator to intervene around a central conductor, and a plug comprising the central contact electrically connected to the central conductor and the external contact electrically connected to the external conductor is such that the central contact and the external contact rotate with an axis in a direction orthogonal to the axial direction of the central conductor as a rotational axis while maintaining respective electrical connections with the central contact and the central conductor connecting member and the external contact and the external conductor connecting member.

First Embodiment

Figure 2:
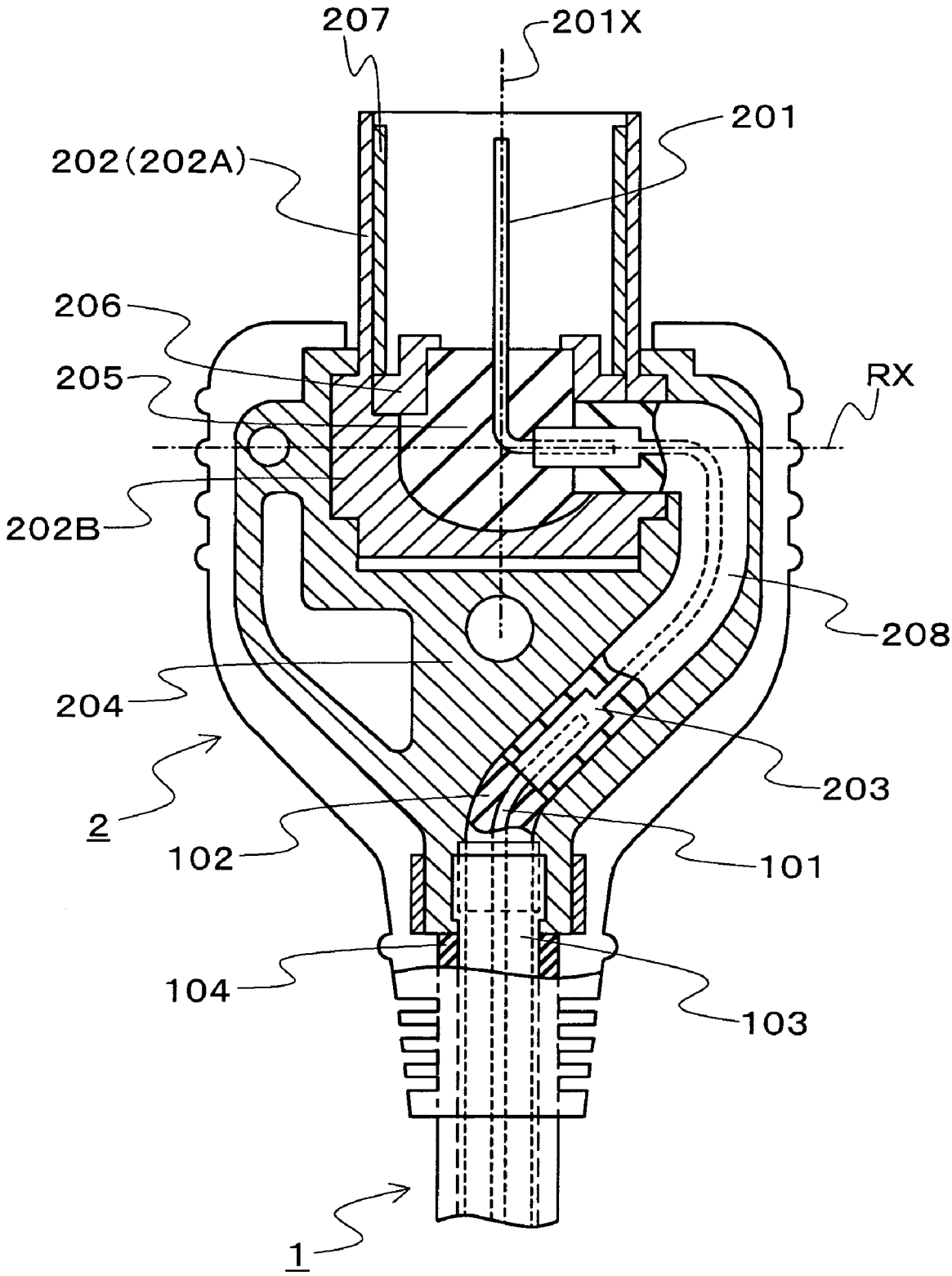
FIG. 2 is a schematic illustration showing an internal structure of the coaxial cable with a plug of the first embodiment, and is a view seen from the same direction as FIG. 1.

FIG. 1 is a top view showing an external appearance of a coaxial cable with a plug of a first embodiment according to the present invention. Further, FIG. 2 is a sectional view explaining an internal structure of the coaxial cable with a plug of the first embodiment, and is a view seen from the same direction as FIG. 1. Further, FIG. 3 is a sectional view explaining the internal structure of the coaxial cable with a plug of the first embodiment, and is a view seen from the right side of the sheet surface of FIG. 1.

Figure 3:
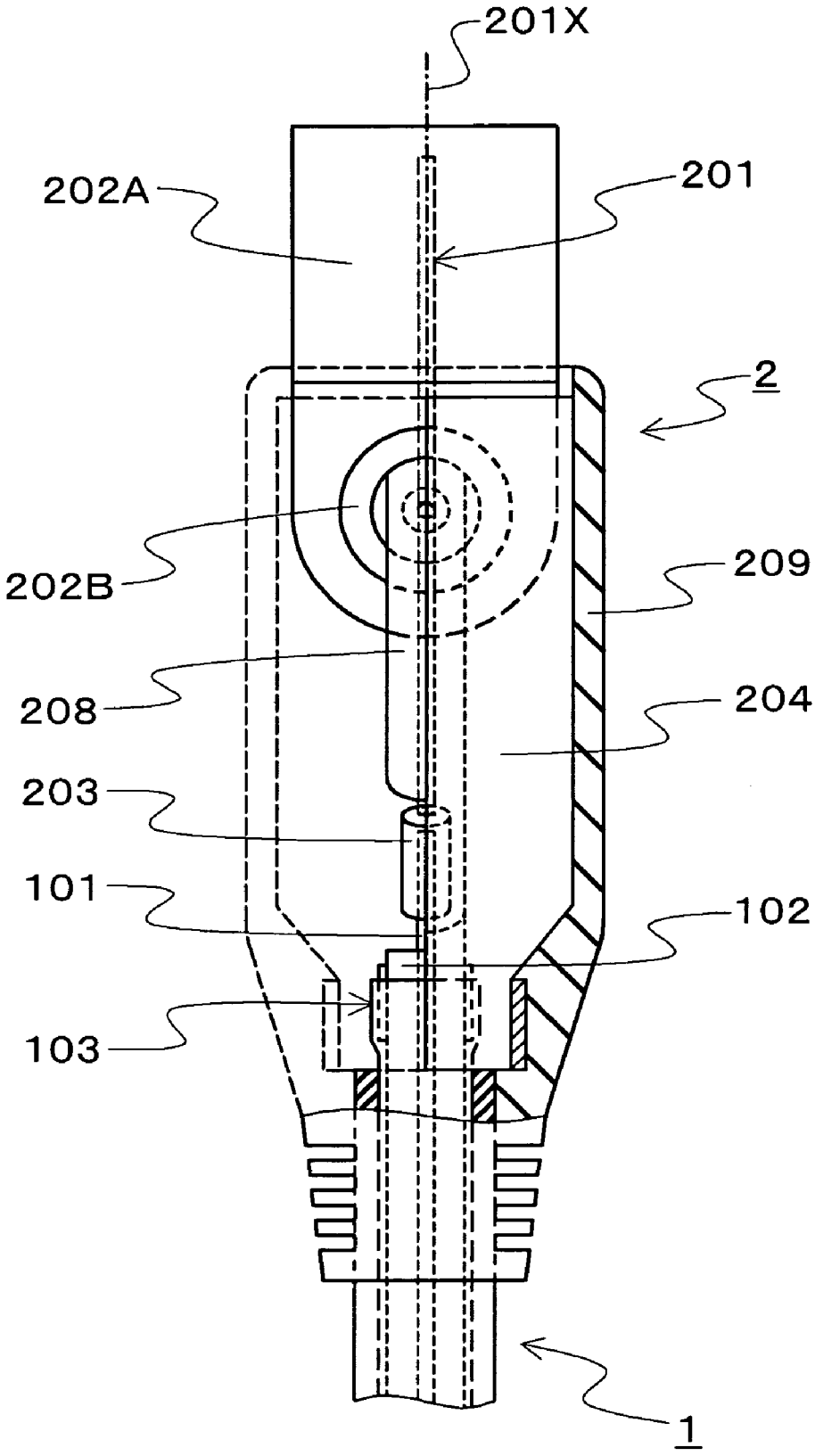
FIG. 3 is a schematic illustration showing an internal structure of the coaxial cable with a plug of the first embodiment, and is a view seen from the right direction of the sheet surface of FIG. 1.

In FIGS. 1, 2 and 3, reference numeral 1 denotes a coaxial cable, reference numeral 101 a central conductor, reference numeral 102 an insulator, reference numeral 103 an external conductor (netted conductor), reference numeral 104 an exterior covering, reference numeral 2 a plug, reference numeral 201 a central contact, reference numeral 202 an external contact, reference numeral 203 a central conductor connecting member, reference numeral 204 an external conductor connecting member, reference numeral 205 a first insulating member, reference numeral 206 an injection ring, reference numeral 207 an inner spring, reference numeral 208 a second insulating member, and reference numeral 209 an insulating cover.

The coaxial cable with a plug of the first embodiment, as shown in FIG. 1, comprises a coaxial cable 1 provided with an external conductor (netted conductor) 103 allowing the insulator 102 to intervene around the central conductor 101, and the plug 2 provided with the central contact 201 and the external contact 202. At this time, the plug 2 is of a push-on system, and the central contact 201 and the external contact 202 are connecting terminal portions, which are plugged into other coaxial cables or a receptacle jack provided at home (room) and the wall side face and the like of electronic equipment.

Further, at this time, the central contact 201 and the central conductor 101, as shown in FIG. 2, are electrically connected by the external conductor connecting member 203 provided inside the plug 2. Further, the external contact 202 and the external conductor 103, as shown in FIG. 2 are also electrically connected by the external conductor connecting member 204 inside the plug 2.

Further, the central contact 201, as shown in FIG. 2, is fixed by the first insulating member 205 and the injection ring 206 so as to maintain a relative position with the external contact 202. Further, in the inside of a cylindrical conductor portion 202A of the external contact 202, there is provided the inner spring 207 to make a favorable contact with the receptacle jack.

Further, the central conductor connecting member 203 and the external conductor connecting member 204 are provided so as to maintain a coaxial structure by allowing the second insulating member 208 to intervene.

Further, the central contact 201, as shown in FIG. 2, is bent in such a way that a connecting portion with the central conductor connecting member 203 is superposed with an axis (hereinafter referred to as a second axis) RX in a direction orthogonal to a main axis (hereinafter referred to as a first axis) 201X of the central contact 201. Further, the central contact 201 and the central conductor connecting member 203 are mechanically in a contacted state, and the central contact 201 is allowed to make a rotational movement with the second axis RX as a rotational axis.

Further, the external contact 202, as shown in FIG. 2, is provided with a protrusion 202B which becomes a point of support for rotation at one end of the cylindrical conductor portion 202A, in other words, at the connecting portion with the external conductor connecting member 204. At this time, the protrusion 202B, as shown in FIG. 3, is a disk-shaped protrusion such that a protrusion 202 can make a rotational movement with the second axis RX as a rotational axis, and the external conductor connecting member 204 supports the protrusion 202B of the external contact 202 to nip it, and is mechanically in a contacted state with it.

Further, outside of the external conductor connecting member 204, there is provided a packing insulation cover 209.

FIGS. 4 to 11 are schematic illustrations explaining an assembly method of the coaxial cable with a plug of the first embodiment.

Figure 4:
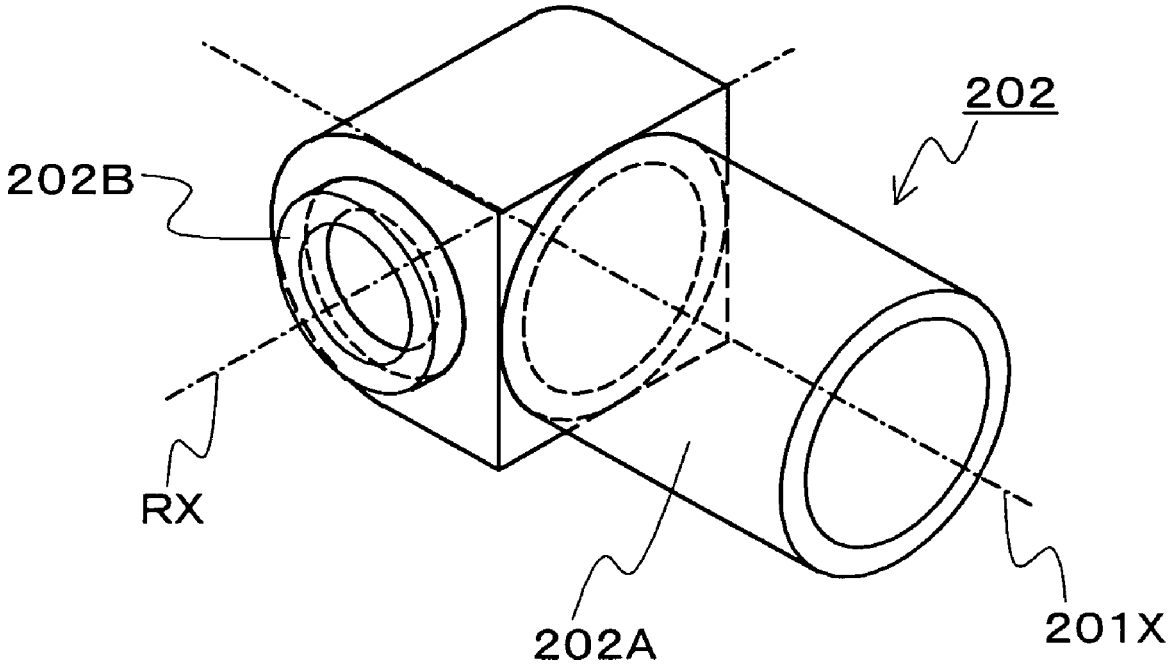
FIG. 4 is a schematic illustration to explain an assembly method of the coaxial cable with a plug of the first embodiment.
Figure 4:
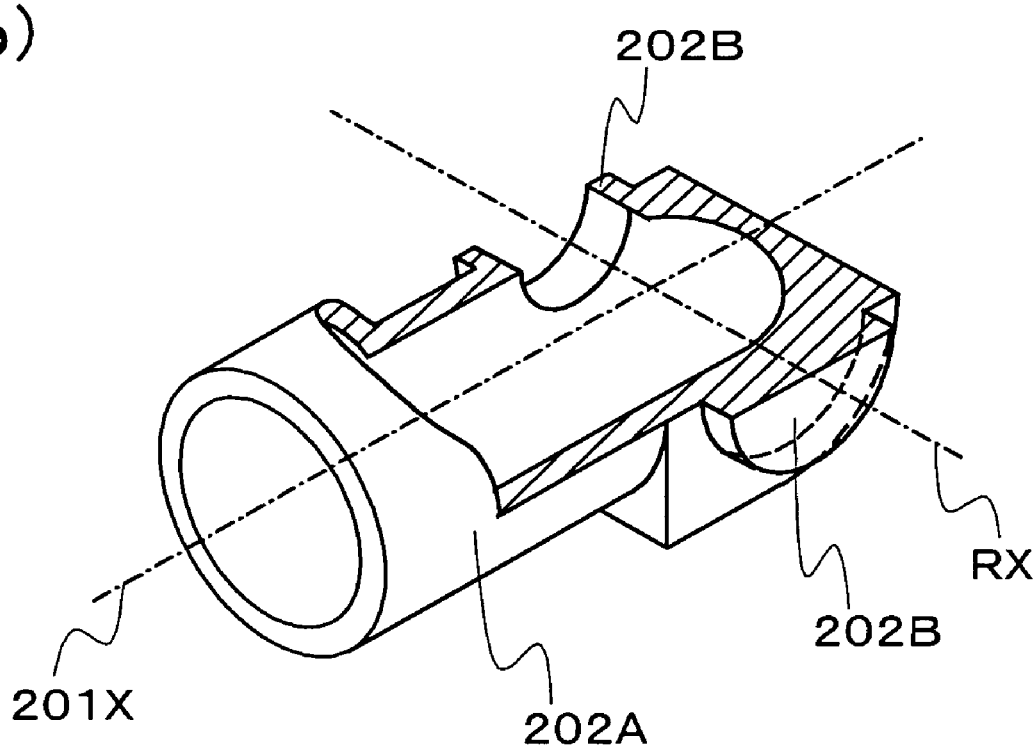

When the coaxial cable with a plug of the first embodiment is to be assembled, first, for example, the external contact 202 as shown in FIGS. 4(*a*) and 4(*b*) is prepared. The external contact 202 provides a rotational point of support comprising a pair of protrusions 202B in which the axis RX (second axis) becomes a rotational axis in a direction orthogonal to the central axis of the cylindrical conductor portion 202A at one end of the cylindrical conductor portion 202A. Further, at this time, as shown in FIG. 4(*b*), an opening is made from the one protrusion 202B so as to communicate with an inner space of the cylindrical conductor portion 202A.

Figure 5:
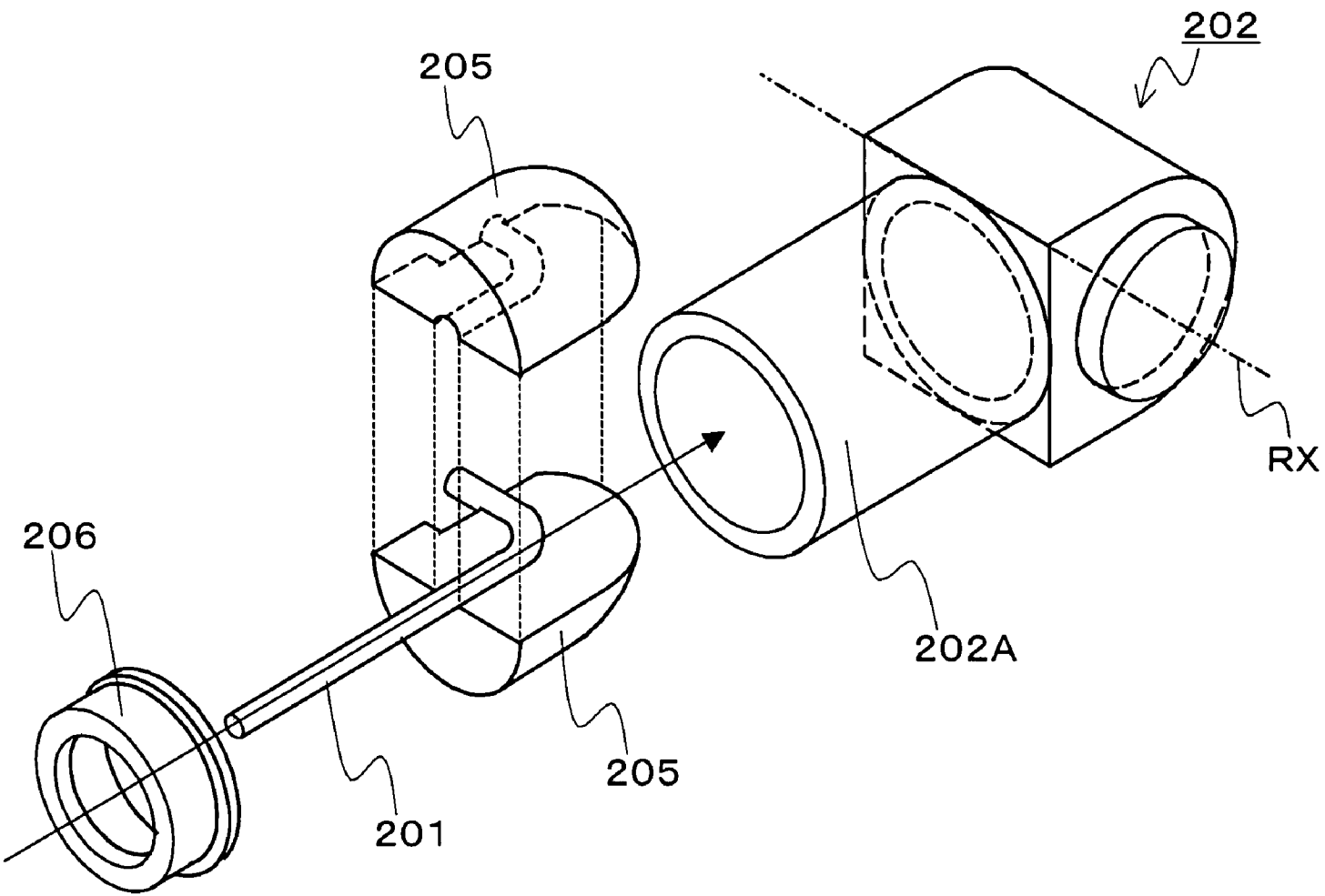
FIG. 5 is a schematic illustration to explain an assembly method of the coaxial cable with a plug of the first embodiment.

Next, as shown in FIG. 5, the L-shaped central contact 201 is nipped by the first insulating member 205 of a half-divided structure, and is inserted into the cylindrical conductor portion 202A of the external contact. At this time, a portion connected to the central conductor connecting portion of the central contact 201 is pointed at an opening direction of a protrusion 201B, and the injection ring 206 in a state superposed with the second axial RX is pushed, thereby fixing the first insulating member 205.

Figure 6:
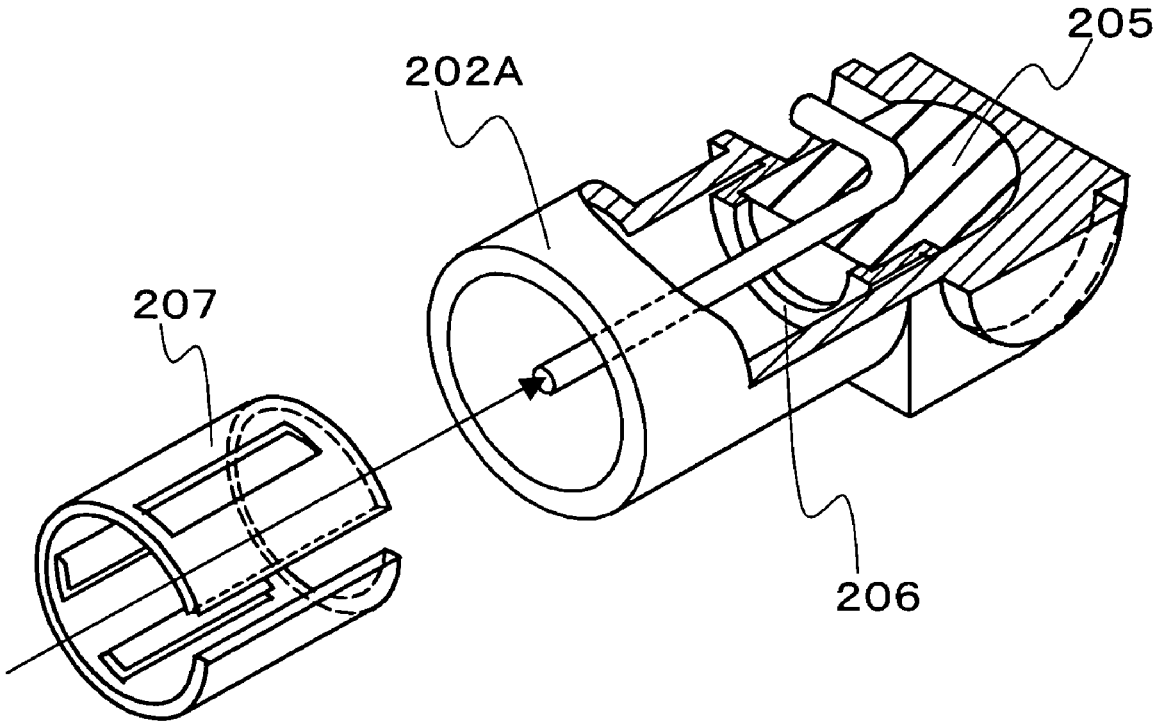
FIG. 6 is a schematic illustration to explain an assembly method of the coaxial cable with a plug of the first embodiment.

Next, for example, as shown in FIG. 6, the inner spring 207 is inserted into the cylindrical conductor portion 202A of the external contact.

Figure 7:
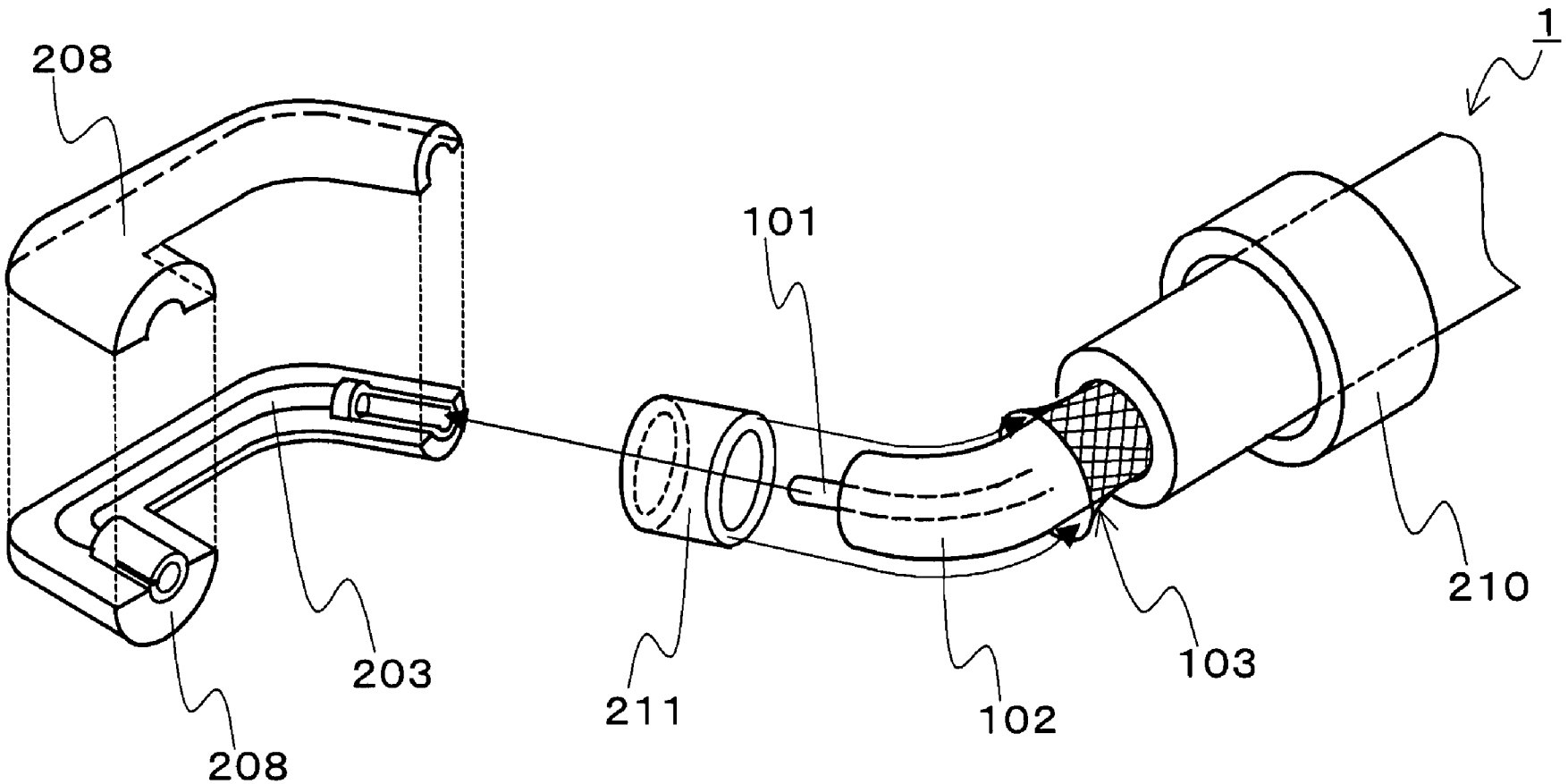
FIG. 7 is a schematic illustration to explain an assembly method of the coaxial cable with a plug of the first embodiment.

Further, while the central contact 201 is inserted into the external contact 202 and fixed, as shown in FIG. 7, the central conductor 101 and the central conductor connecting member 203 of the coaxial cable 1 are connected.

At this time, first, as shown in FIG. 7, the coaxial cable 1 is passed through a caulking ring 210, and a retaining ring 211 is inserted between the external conductor 103 and the insulator 102. The caulking ring 210 is a ring, which is caulked when the coaxial cable 1 is nipped by the external conductor connecting member 204, and assures the electrical connection with the external conductor 103 of the coaxial cable 1 and the external conductor connecting member 204. Further, the retaining rink 211 is a ring, which prevents the insulator 102 of the coaxial cable 1, when caulked by the caulking ring 210, from deforming to change in the impedance.

Further, at this time, the central conductor connecting member 203, with its connecting portion with the central conductor 101 of the coaxial cable 1 gutter-shaped, as shown in FIG. 7, puts on and solders the central conductor 101 of the coaxial cable 1. Further, the connecting portion of the central contact 201 of the central conductor connecting member 203 is given a slot so as to be spring-shaped.

Further, the central conductor 101 of the coaxial cable 1 and the central conductor connecting member 203 are connected, and after that, as shown in FIG. 7, the central conductor 101 and the central conductor connecting member 203 are nipped by the second insulating member 208 of the half-divided structure.

Figure 8:
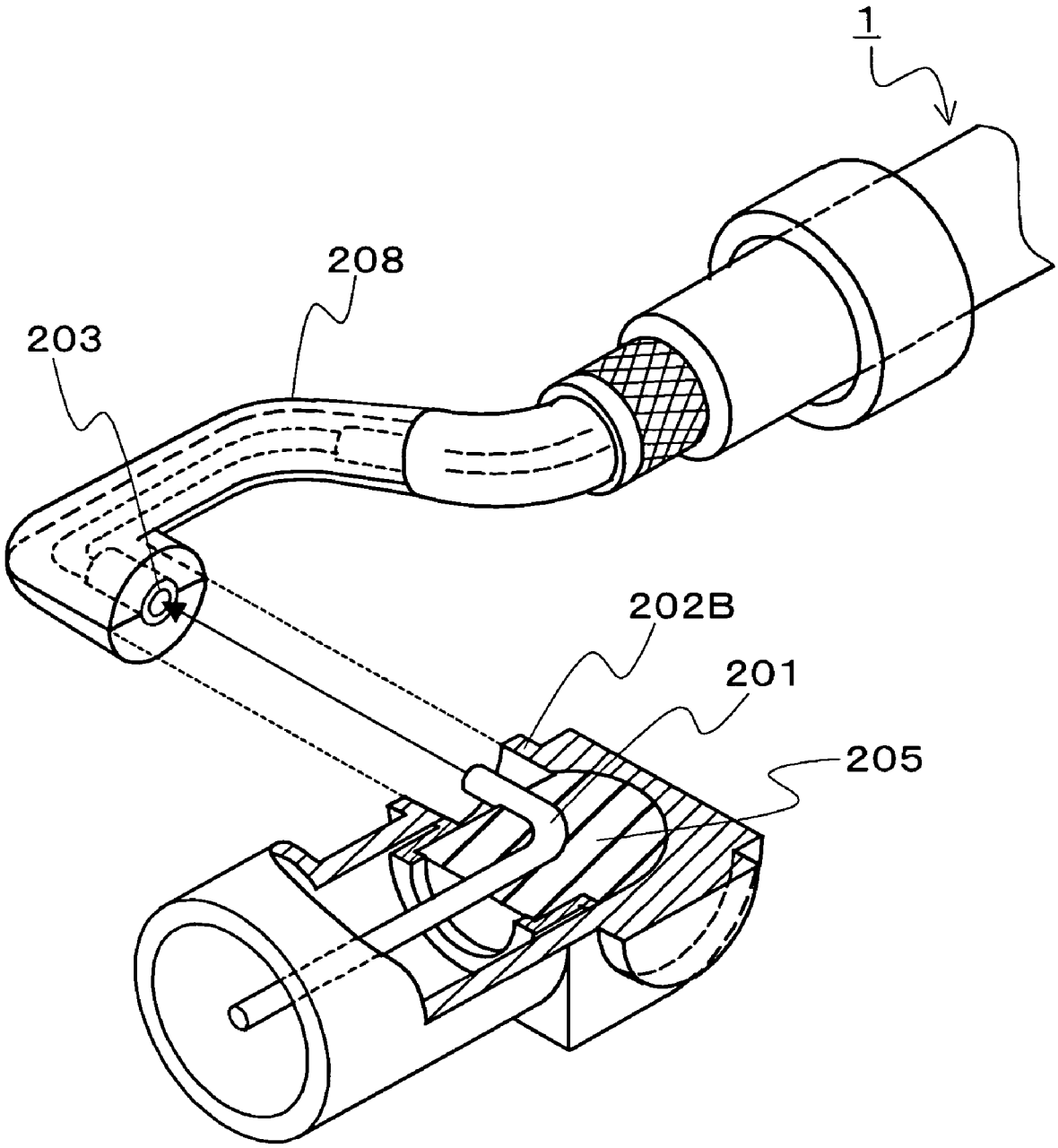
FIG. 8 is a schematic illustration to explain an assembly method of the coaxial cable with a plug of the first embodiment.

Next, as shown in FIG. 8, the central conductor connecting member 203 which connects the coaxial cable 1 and the central contact 201 which is inserted and fixed to the external contact 202 are connected. At this time, the central contact 201 is not given a mechanical connection such as soldering so as to allow it to make a rotational movement. Further, at this time, the second insulating member 208 which nips the central conductor connecting member 203 is inserted in the opening provided for the protrusion 202B of the external contact 202, so that the second insulating member 208 and the first insulating member 205 are adhered.

Figure 9:
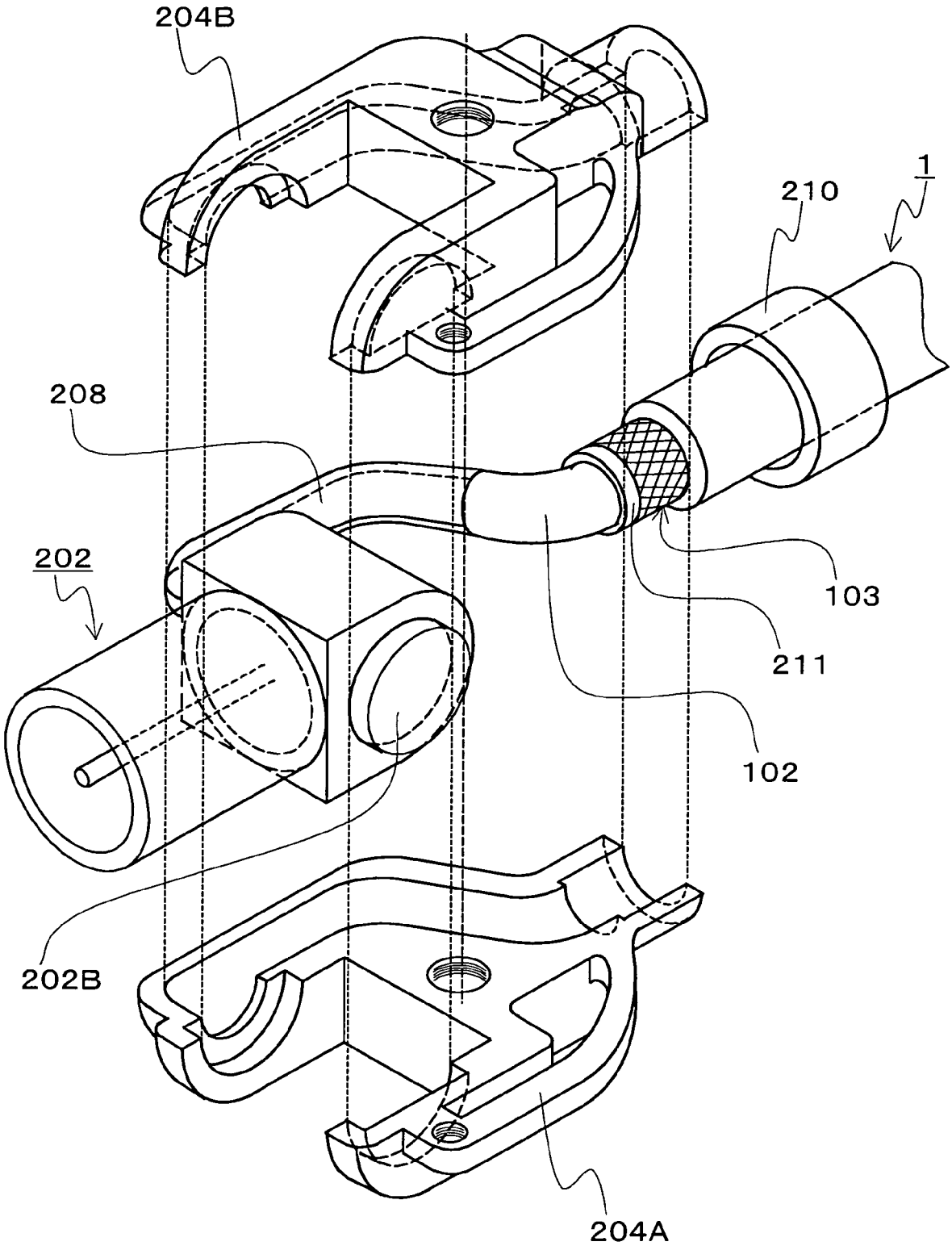
FIG. 9 is a schematic illustration to explain an assembly method of the coaxial cable with a plug of the first embodiment.

Next, as shown in FIG. 9, by the external conductor connecting members 204A and 204B which are divided into two portions, the protrusion 202B of the external contact 202, the central conductor connecting member 203 (second insulating member 208), and the external conductor 103 of the coaxial cable 1 are nipped and fixed by screws and the like. After that, by the caulking ring 210, the connecting portion of the external conductor connecting members 204A and 204B and the external conductor 103 of the coaxial cable 1 are fixed.

Figure 10:
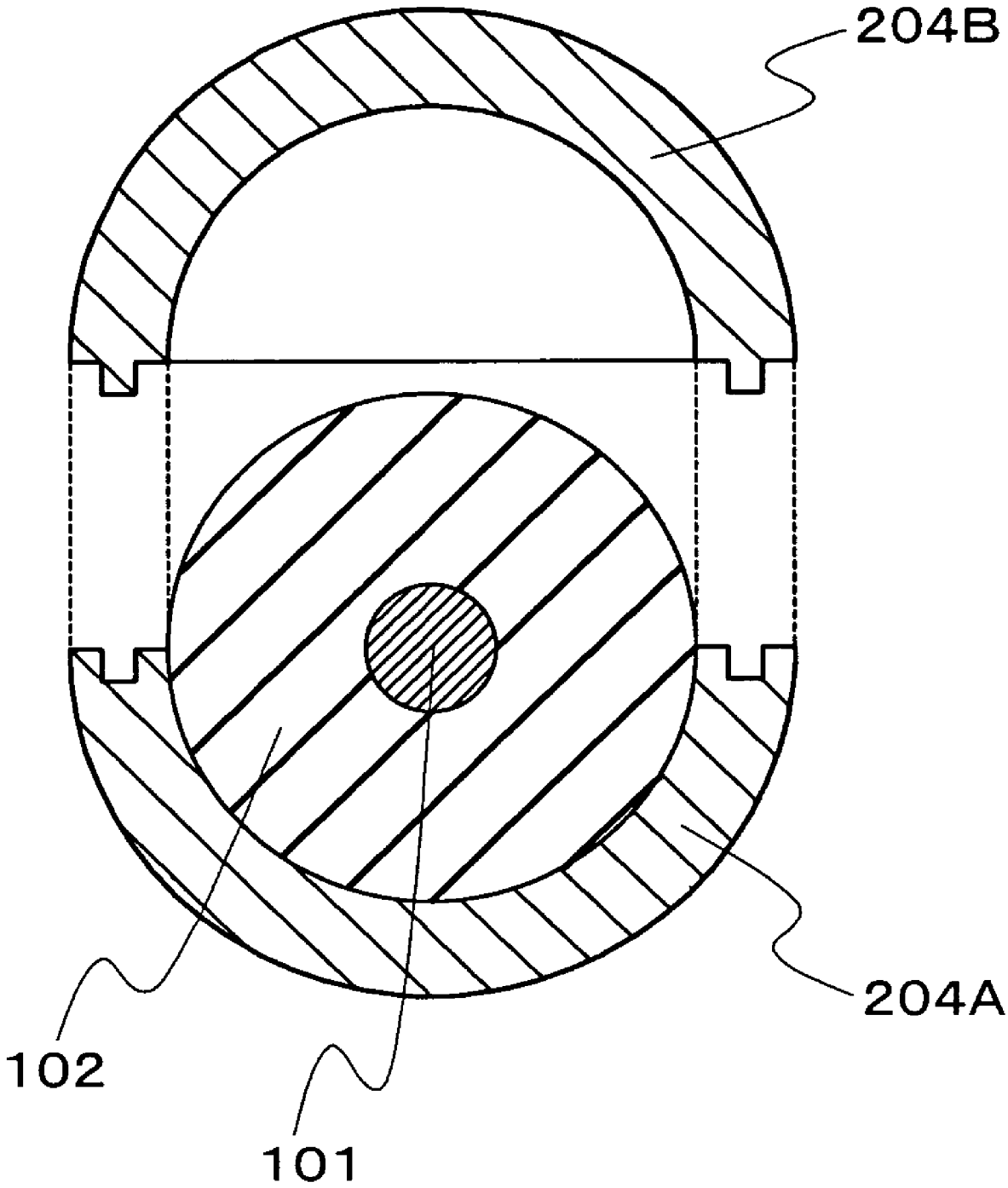
FIG. 10 is a schematic illustration to explain an assembly method of the coaxial cable with a plug of the first embodiment.
Figure 11:
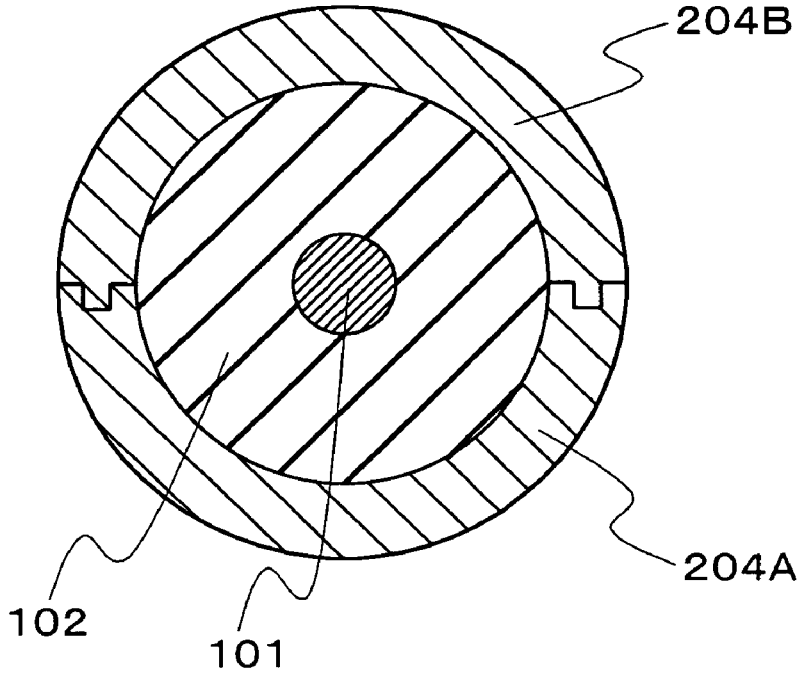
FIG. 11 is a schematic illustration to explain an assembly method of the coaxial cable with a plug of the first embodiment.
Figure 11:
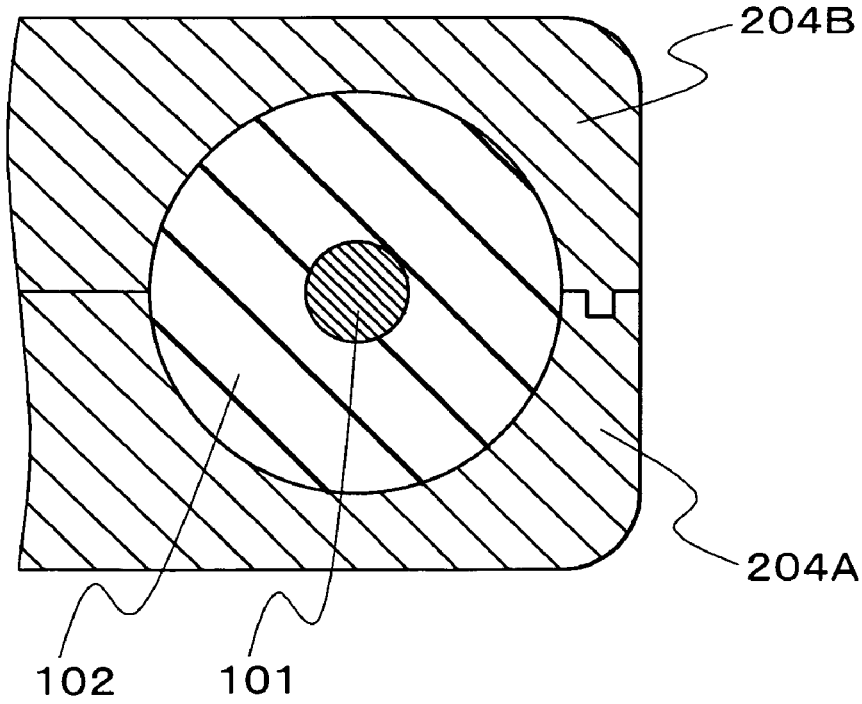

Further, at this time, as shown in FIG. 10, the first external conductor connecting member 204A is provided with grooves, and the second external conductor connecting member 204B is provided with protrusions corresponding to the grooves of the first external conductor connecting member 204A. By providing the grooves and the protrusions, when the first external conductor connecting member 204A and the second external connecting member 204B are fixed, as shown in FIGS. 11(*a*) and 11(*b*), a gap is hard to arise between the first external conductor connecting member 204A and the second external conductor connecting member 204B, the whole peripheries of the insulator 102 of the coaxial cable and the second insulating member 208 can be shielded by the external conductor connection members 204A and 204B. Hence, a leakage of signal from the central conductor 101 of the coaxial cable 1 and the central conductor connecting member 203 can be avoided.

Finally, when the packing insulating cover 209 is attached to the outside of the external conductor connecting members 204A and 204B, the coaxial cable with a plug as shown in FIG. 1 can be acquired.

Figure 12:
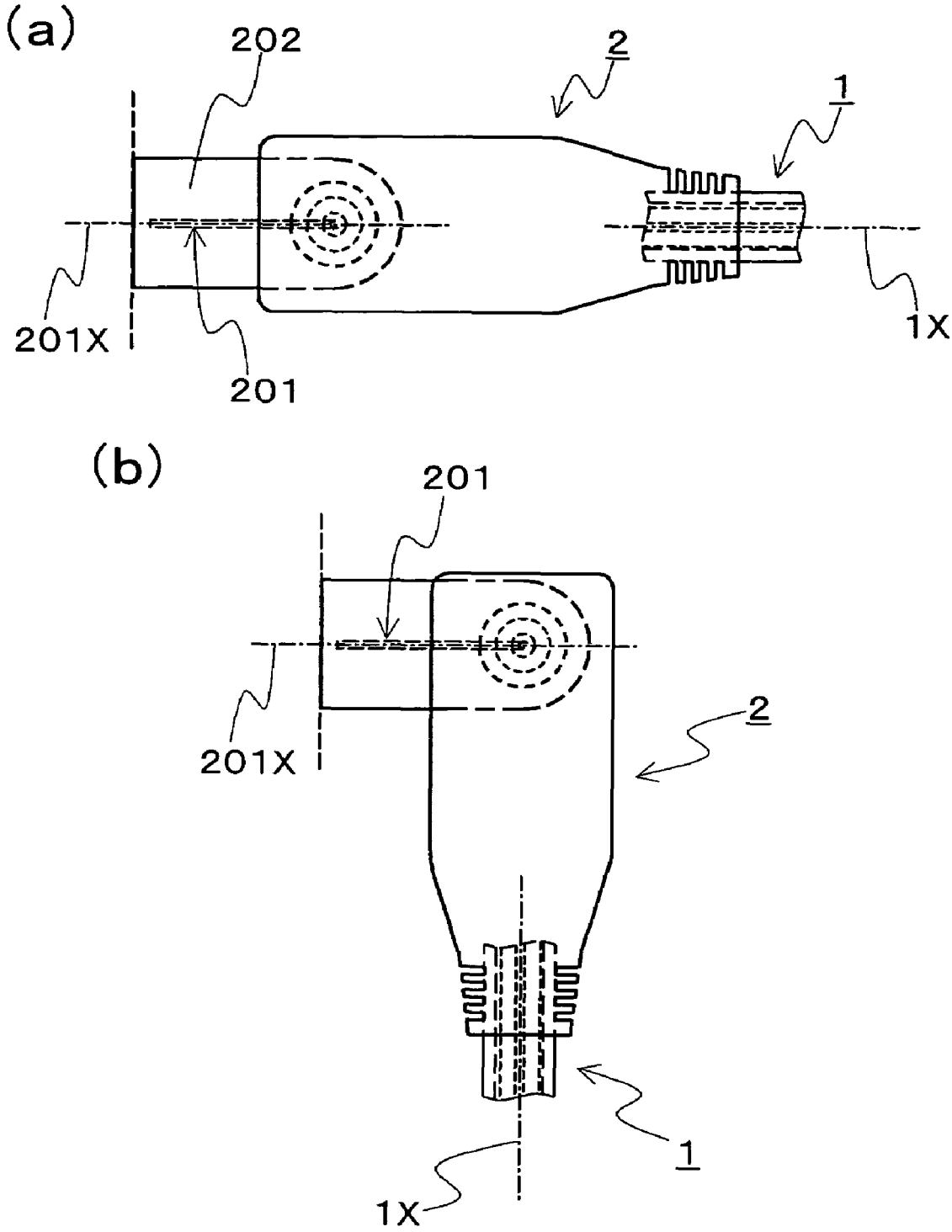
FIG. 12 is a schematic illustration to explain a using method of the coaxial cable with a plug of the first embodiment.

FIG. 12 is a schematic illustration explaining an operational effect of the coaxial cable with a plug of the first embodiment, and FIGS. 12(*a*) and 12(*b*) are side views showing a using state of the coaxial cable with a plug.

In the coaxial cable with a plug of the first embodiment, the external contact 202 is provided with the protrusion 202B at the connecting portion with the external conductor connecting members 204A and 204B, and the central contact 201 and the external contact 202 can be rotated while maintaining the electrical connections with the central contact 201 and the central conductor connecting member 203 and the electrical connections with the external contact 202 and the external conductor connecting members 204A and 204B. Hence, when the coaxial cable with a plug is connected to a receptacle jack (F type jack, receptacle jack) installed at a wall face and the like at home, the angle of the coaxial cable pulled out from the plug can be freely changed within a plane. That is, for example, as shown in FIG. 12(*a*), the coaxial cable can be used in state where the main axial direction (first axis) 201X of the central contact 201 and the direction (third axis) 1X in which the coaxial cable attached with the plug is pulled out are in parallel, and as shown in FIG. 12(*b*), it can be used in state where the first axis 201X and the third axis 1X are orthogonal to each other.

As described above, according to the coaxial cable with a plug of the first embodiment, the central contact 201 and the external contact 202 of the plug rotate while maintaining the electrical contacts with the central conductor 101 and the external conductor 103 of the coaxial cable 1, so that the angle of the main axis 201X of the central contact 201 and the pulled out direction 1X of the coaxial cable 1 can be adjusted according to an application and a usage place. Hence, for example, the proper use of the conventional straight type and the right angle type can be made by one piece of the coaxial cable with a plug of the first embodiment, and a degree of freedom of adaptability to the application and the usage place can be enhanced.

Second Embodiment

FIGS. 13 to 16 are schematic illustrations showing a general structure of a coaxial cable with a plug of a second embodiment according to the present invention, and are oblique views for explaining an assembly procedure of the coaxial cable with a plug.

The external appearance of the coaxial cable with a plug of the second embodiment is the same as the coaxial cable with a plug of the first embodiment, and as shown in FIG. 1, a plug 2 comprising the central contact 201 and the external contact 202 is attached to the end portion of the coaxial cable 1. Further, the central contact 201 and the external contact 202, similarly to the coaxial cable with a plug of the first embodiment, can be rotated with the second axis RX orthogonal to the first axis 201X as a rotational axis.

The assembly method of the coaxial cable with a plug of the second embodiment will be described below along with FIGS. 13 to 16. The same portions as the first embodiment will be described by using each drawing used in the first embodiment.

First, as shown in FIGS. 4 and 5, along with the procedure described in the first embodiment, the L-shaped central contact 201 nipped by the first insulating member 205 is inserted into the external contact 202 having a protrusion 202B which becomes a point of support for rotation, and is fixed by an injection ring 206, and a contact portion into which an inner spring (not shown) is inserted is prepared.

Figure 13:
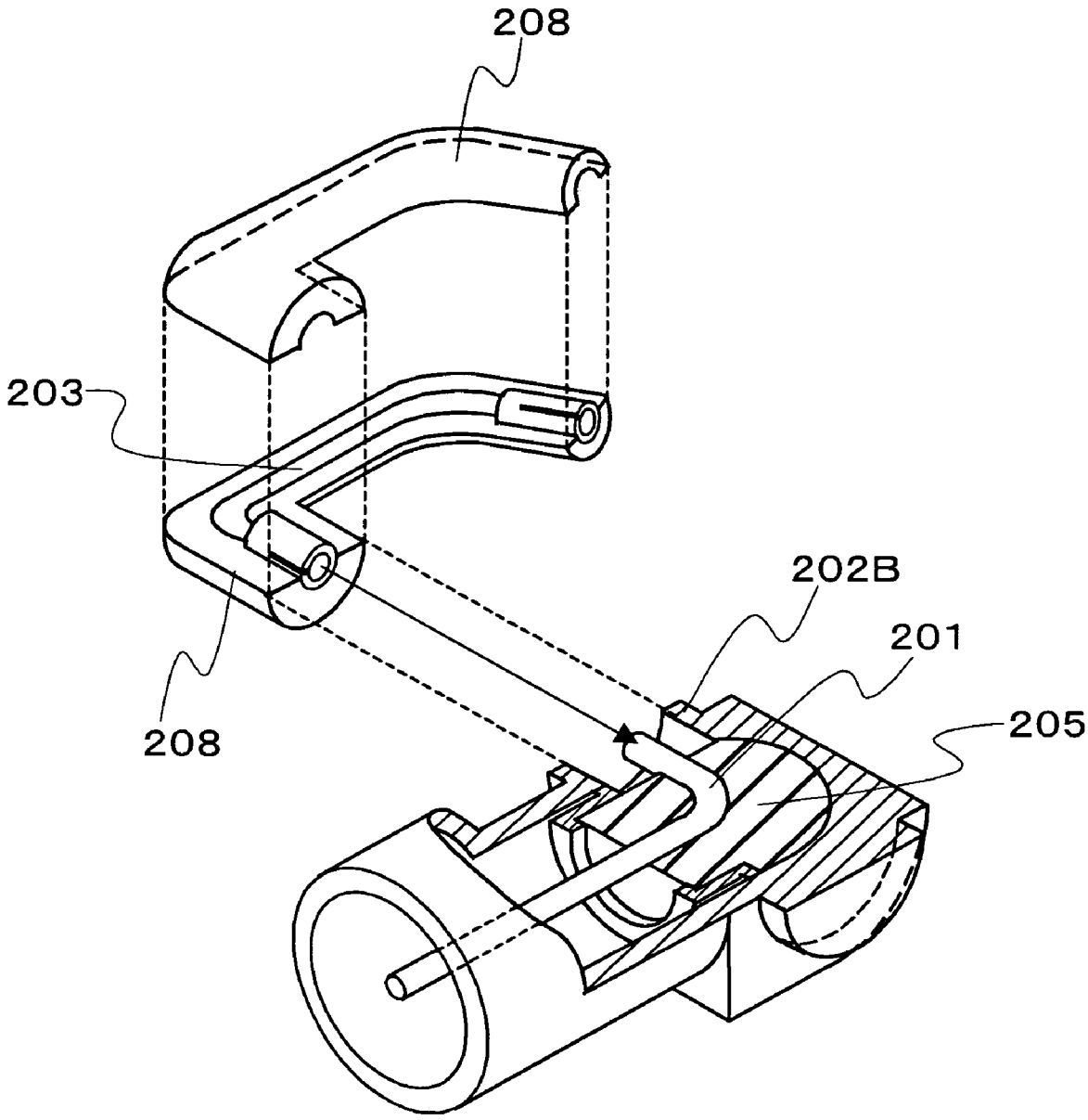
FIG. 13 a schematic illustration to explain an assembly method of the coaxial cable with a plug of a second embodiment according to the present invention.

Next, as shown in FIG. 13, a central connecting member 203 is nipped by a second insulating member 208 of a half-divided structure, and the central conductor connecting member 203 and the central contact 201 are connected. At this time, as described in the first embodiment, a connecting portion with the central contact 201 of the central conductor connecting member 203 is provided with a slot so that it becomes spring-shaped. Further, the connecting portion of the central conductor of the coaxial cable of the central conductor connecting member 203 is also provided with a slot so that it becomes spring-shaped.

Figure 14:
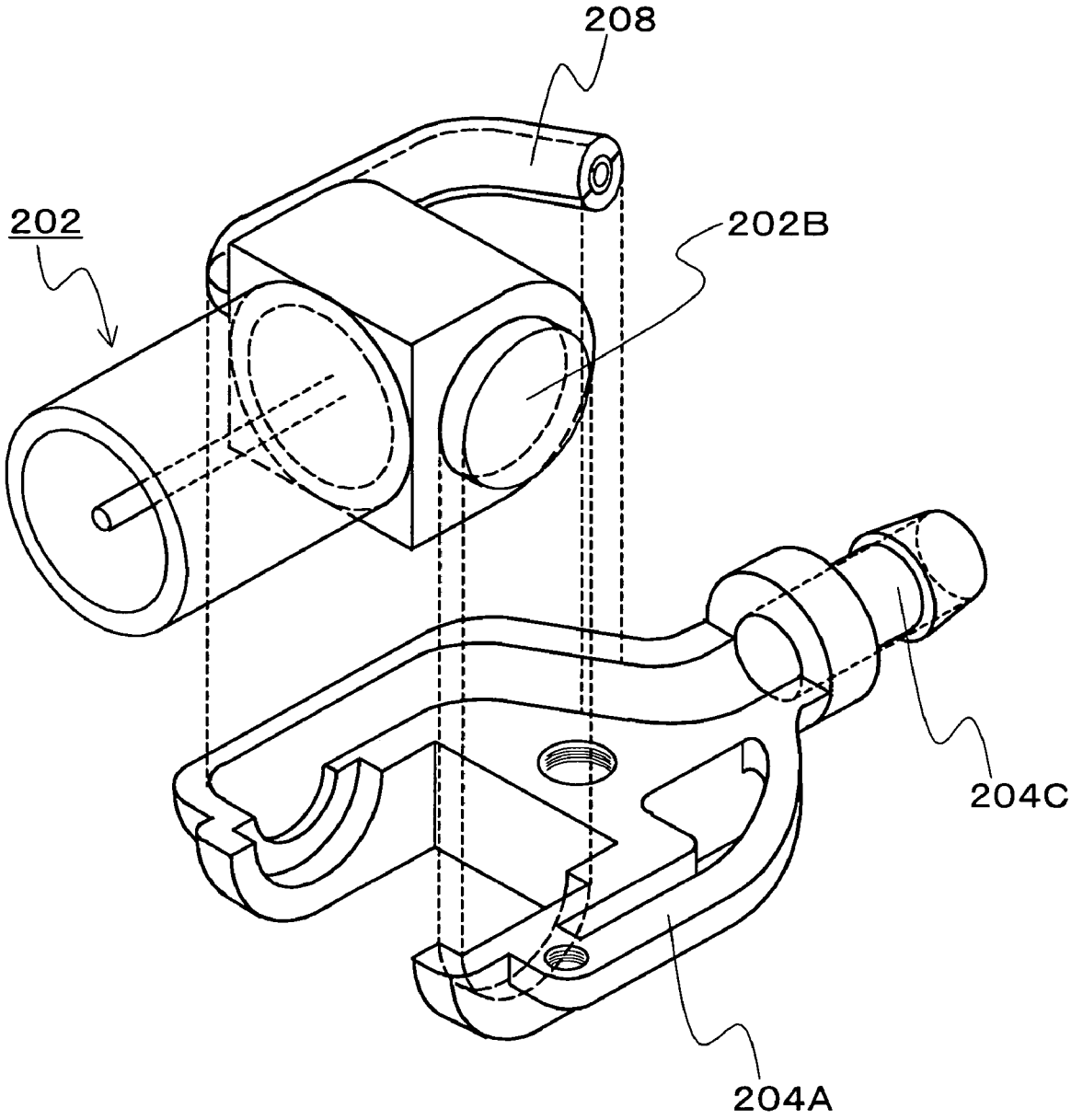
FIG. 14 is a schematic illustration to explain an assembly method of the coaxial cable with a plug of the second embodiment.

Next, as shown in FIG. 14, the contact portion connected to the central conductor connecting member 203 is fitted into a first external conductor connecting member 204A in which grooves corresponding to the external shapes of the protrusion 202B of the external contact 202 and the central conductor connecting member 203 (second insulating member 208) are provided. At this time, the portion to which the coaxial cable 1 of the first external conductor connecting member 204A is attached, as shown in FIG. 14, is provided with a cable fixing pipe 204C.

Figure 15:
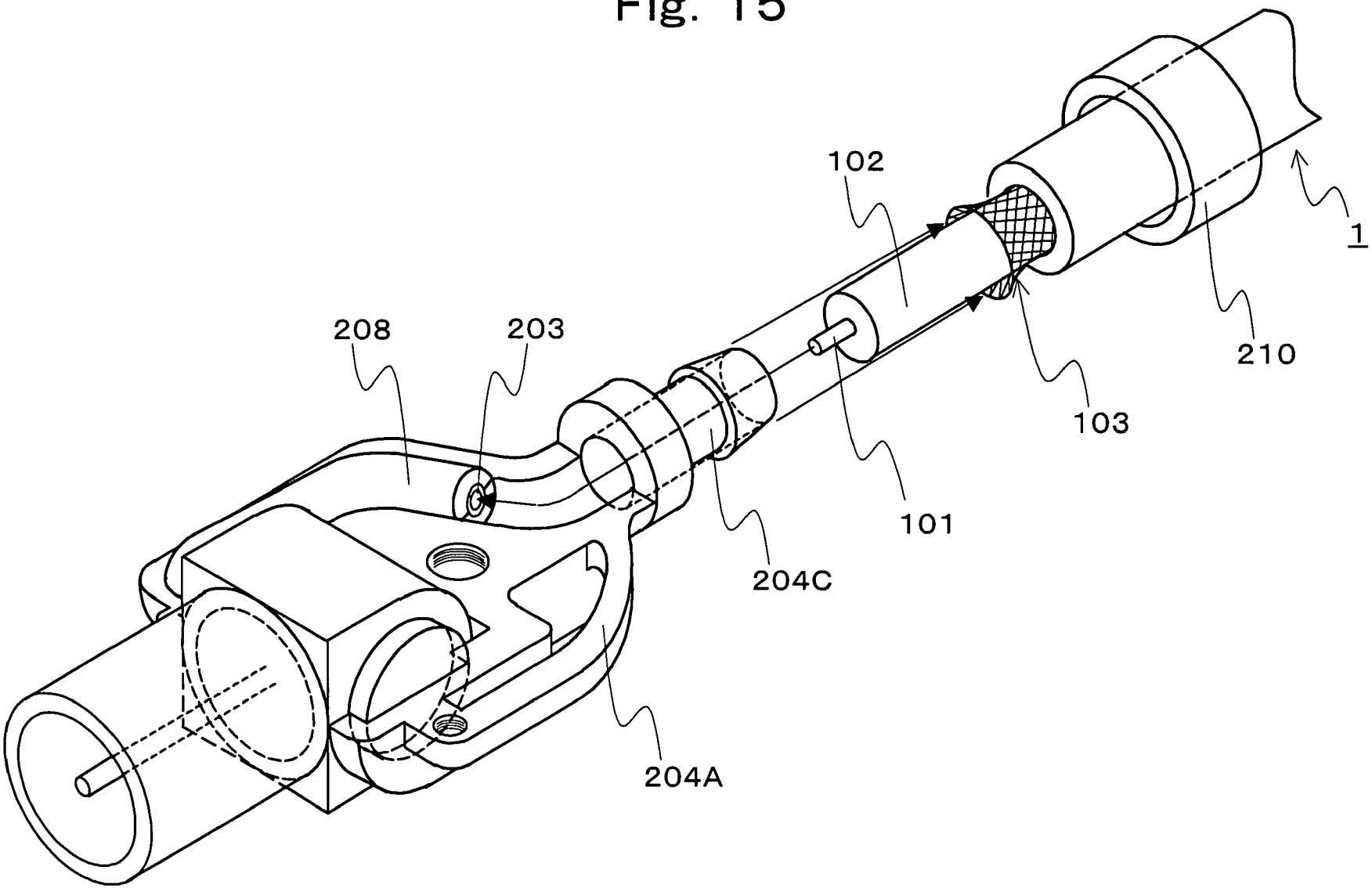
FIG. 15 is a schematic illustration to explain an assembly method of the coaxial cable with a plug of the second embodiment.

Next, as shown in FIG. 15, the coaxial cable 1 is inserted from the pipe 204C of the first external conductor connecting member 204A, and a central conductor 101 of the coaxial cable 1 and the central conductor connecting member 203 are connected. At this time, the pipe 204C of the first external conductor connecting member is inserted between an insulator 102 which insulates the central conductor 101 and an external conductor 103 of the coaxial cable 1 and the external conductor 103. Further, at this time, the insulator 102 of the coaxial cable 1 and the second insulating member 208 are connected so as to be adhered.

Figure 16:
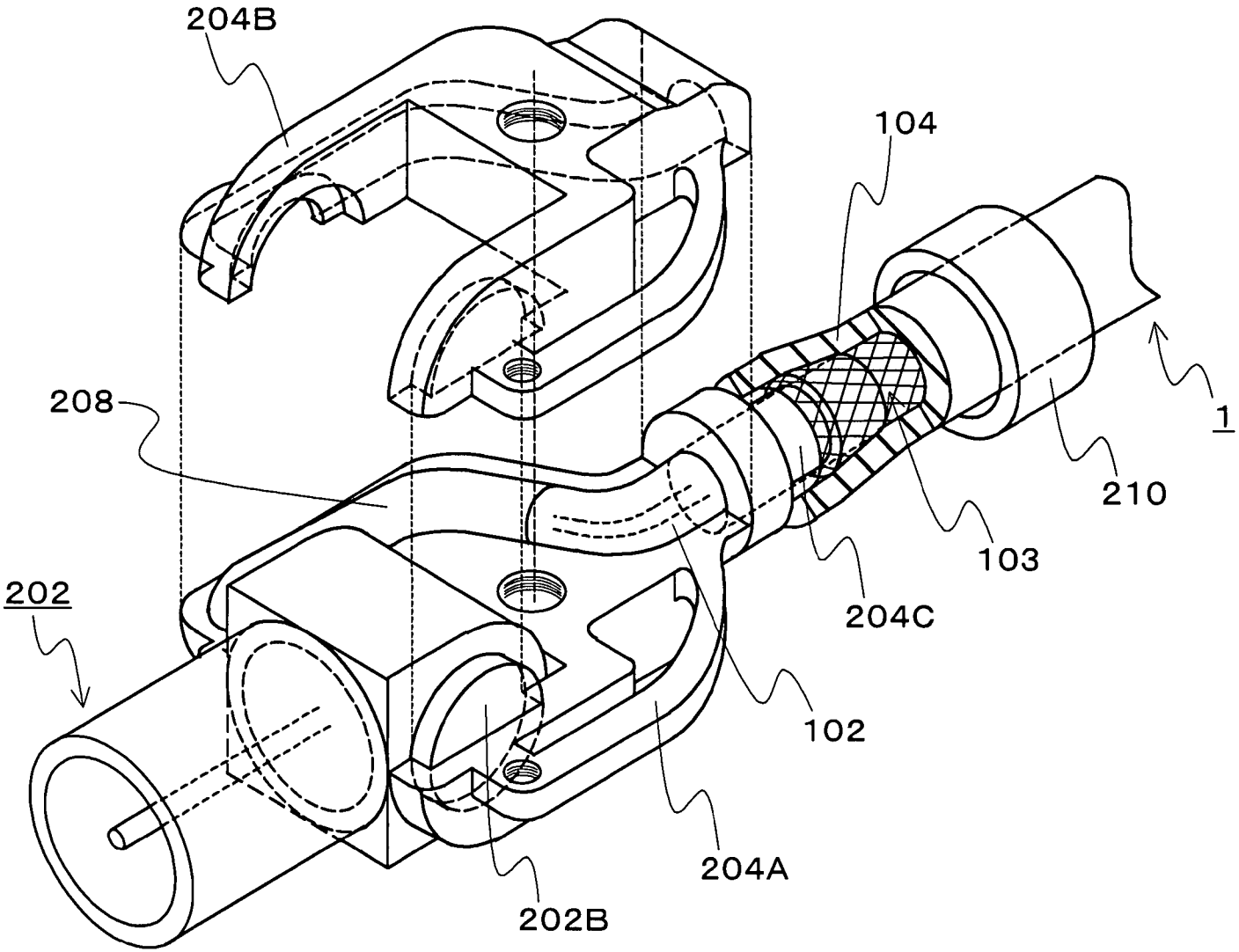
FIG. 16 is a schematic illustration to explain an assembly method of the coaxial cable with a plug of the second embodiment.

Next, as shown in FIG. 16, the first external conductor connecting member 204A is covered with a second external conductor connecting member 204B, and is fixed by screws and the like. At this time, since the central conductor 101 of the coaxial cable 1 and the central conductor connecting member are not connected by soldering and the like, there is a risk of the coaxial cable 1 being pulled out. Hence, the portion of the pipe 204C in which the coaxial cable 1 to be connected is passed through is caulked by a caulking ring 210, so that the coaxial cable 1 is fixed so as not to be pulled out.

As described above, according to the coaxial cable with a plug of the second embodiment, similarly to the coaxial cable with a plug of the first embodiment, can allow the central contact and the external contact to rotate. Hence, for example, the proper use of the conventional straight type and the right angle type can be made by one piece of the coaxial cable with a plug of the second embodiment, and a degree of freedom of adaptability to the application and the usage place can be enhanced.

Third Embodiment

FIGS. 17 to 20 are schematic illustration showing a general structure of a coaxial cable with a plug of a third embodiment according to the present invention, and are oblique views for explaining an assembly procedure of the coaxial cable with a plug.

The external appearance of the coaxial cable with a plug of the third embodiment is also the same as the coaxial cable with a plug of the first embodiment, and as shown in FIG. 1, the plug 2 comprising the central contact 201 and the external contact 202 is attached to the end portion of the coaxial cable 1. Further, the central contact 201 and the external contact 202, similarly to the coaxial cable with a plug of the first embodiment, can be also rotated with the second axis RX orthogonal to the fist axis 201X as a rotational axis.

The assembly method of the coaxial cable with a plug of the third embodiment will be described below along with FIGS. 17 to 20. Those parts similar to the first embodiment will be described by using each drawing showing in the first embodiment.

First, as shown in FIGS. 4 and 5, along with the procedure shown in the first embodiment, the L-shaped central contact 201 nipped by the first insulating member 205 is inserted into the external contact 202 having a protrusion 202B which becomes a point of support for rotation, and is fixed by an injection ring 206, and a contact portion into which an inner spring 207 is inserted is prepared.

Figure 17:
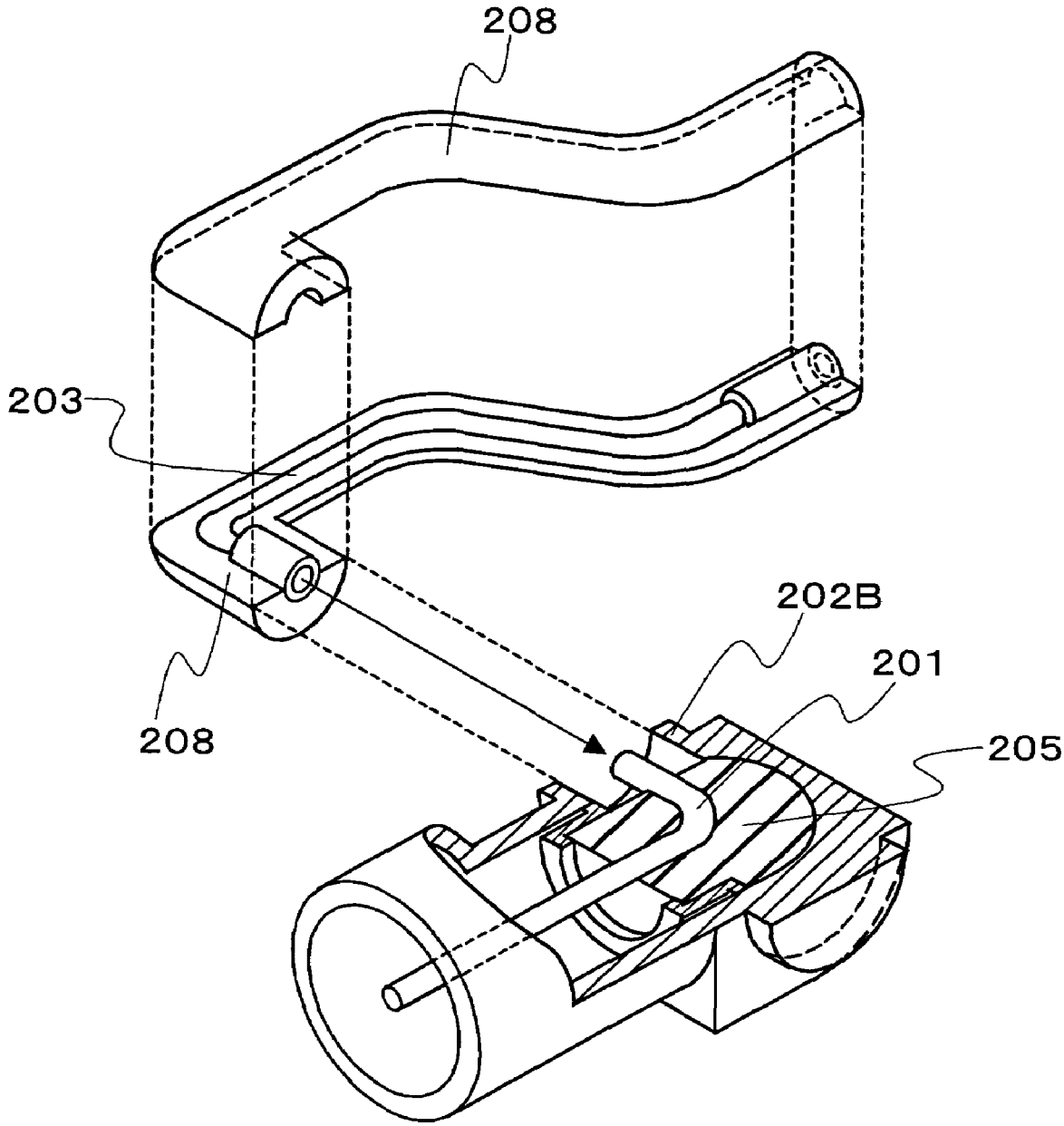
FIG. 17 is a schematic illustration to explain an assembly method of the coaxial cable with a plug of a third embodiment according to the present invention.

Next, as shown in FIG. 17, a central connecting member 203 is nipped by a second insulating member 208 of a half-divided structure, and the central conductor connecting member 203 and the central contact 201 are connected. At this time, similarly to the coaxial cable with a plug of the second embodiment, a connecting portion with the central contact 201 of the central conductor connecting member 203 is provided with a slot so that it becomes spring-shaped. Further, the connecting portion with the central conductor of the coaxial cable of the central conductor connecting member 203 is also provided with a slot so that it becomes spring-shaped.

Figure 18:
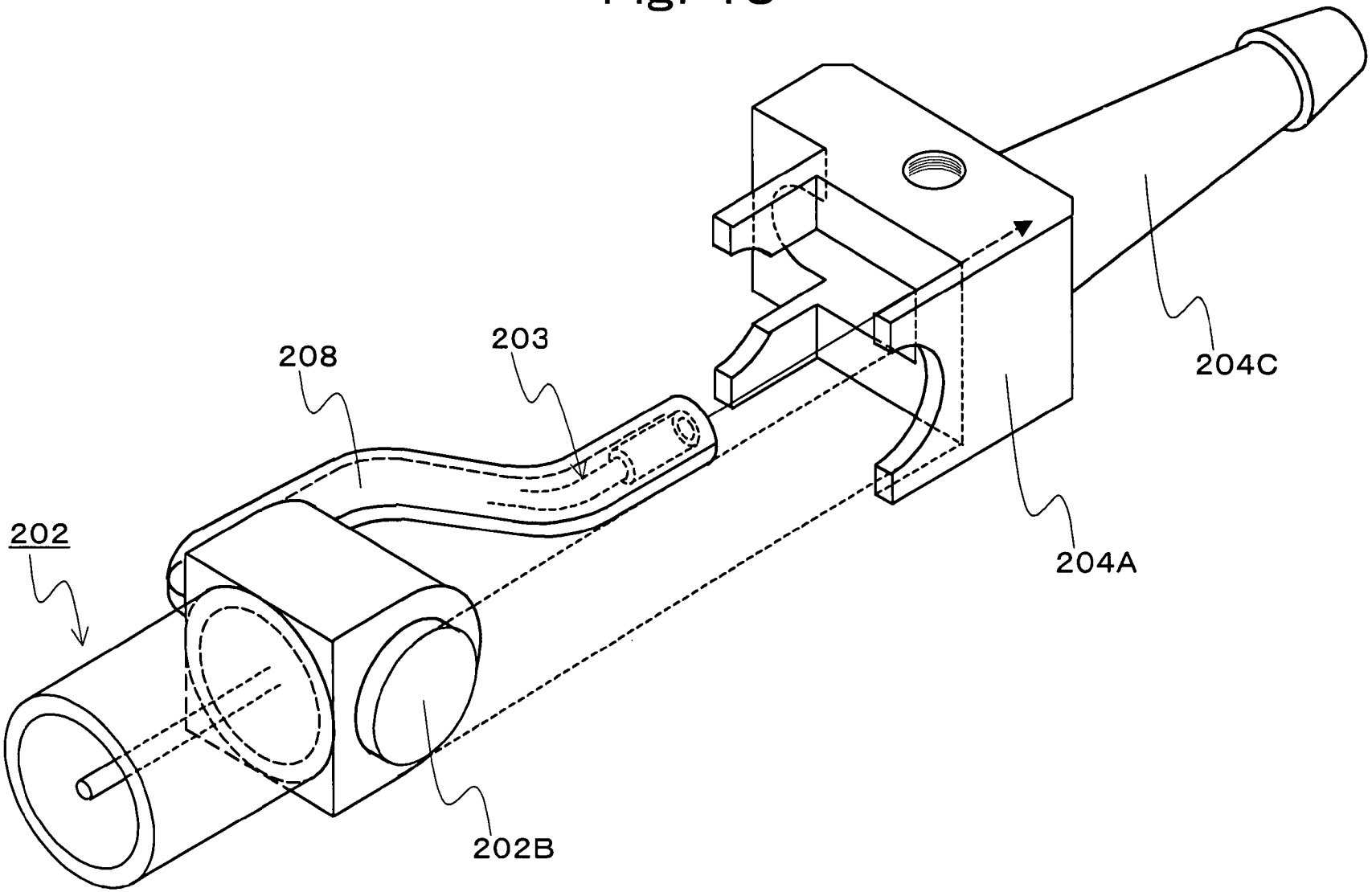
FIG. 18 is a schematic illustration to explain an assembly method of the coaxial cable with a plug of the third embodiment.

Next, as shown in FIG. 18, the contact portion connecting the central conductor connecting member 203 is fitted into a first external conductor connecting member 204A provided with grooves corresponding to protrusions 202B of the external contact 202 and the central conductor connecting member 203 (second insulating member 208).

At this time, in the coaxial cable with a plug of the third embodiment, different from the cases of the first and second embodiments, the first external conductor connecting member 204A is divided at a plane parallel with the flat surface including the first axis 201X and the second axis (rotational axis) RX. Further, at this time, the portion, to which the coaxial cable 1 of the first external conductor connecting member 204A is attached, is provided with a cable fixing pipe 204C as shown in FIG. 18.

Figure 19:
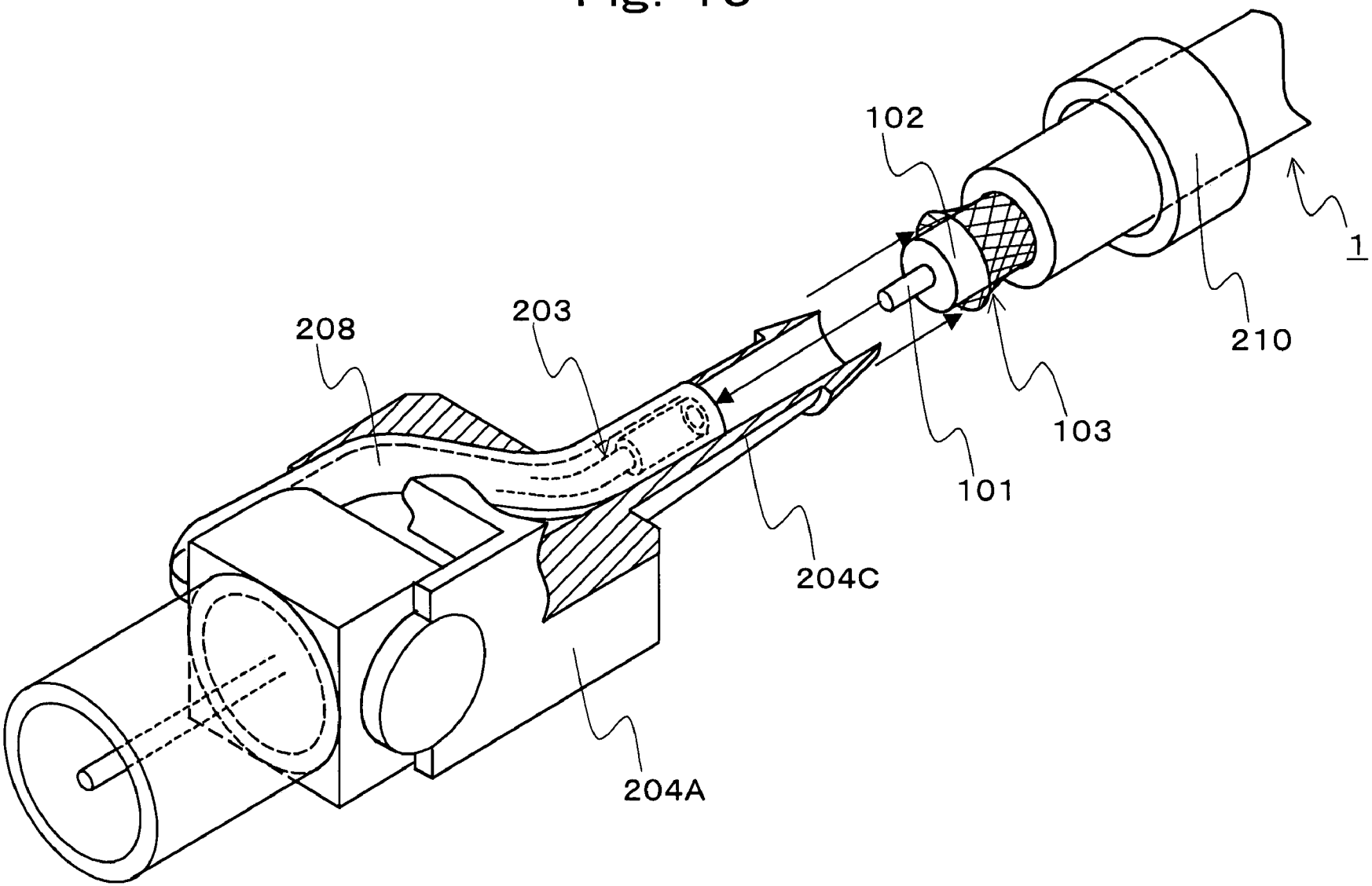
FIG. 19 is a schematic illustration to explain an assembly method of the coaxial cable with a plug of the third embodiment.

Next, as shown in FIG. 19, the coaxial cable 1 is inserted from the pipe 204C of the first external conductor connecting member 204A, and a central conductor 101 of the coaxial cable 1 and the central conductor connecting member 203 are connected. At this time, the pipe 204C of the first external conductor connecting member 204A is inserted between an insulator 102, which insulates the central conductor 101 and the external conductor 103 of the coaxial cable 1, and the external conductor 103.

Figure 20:
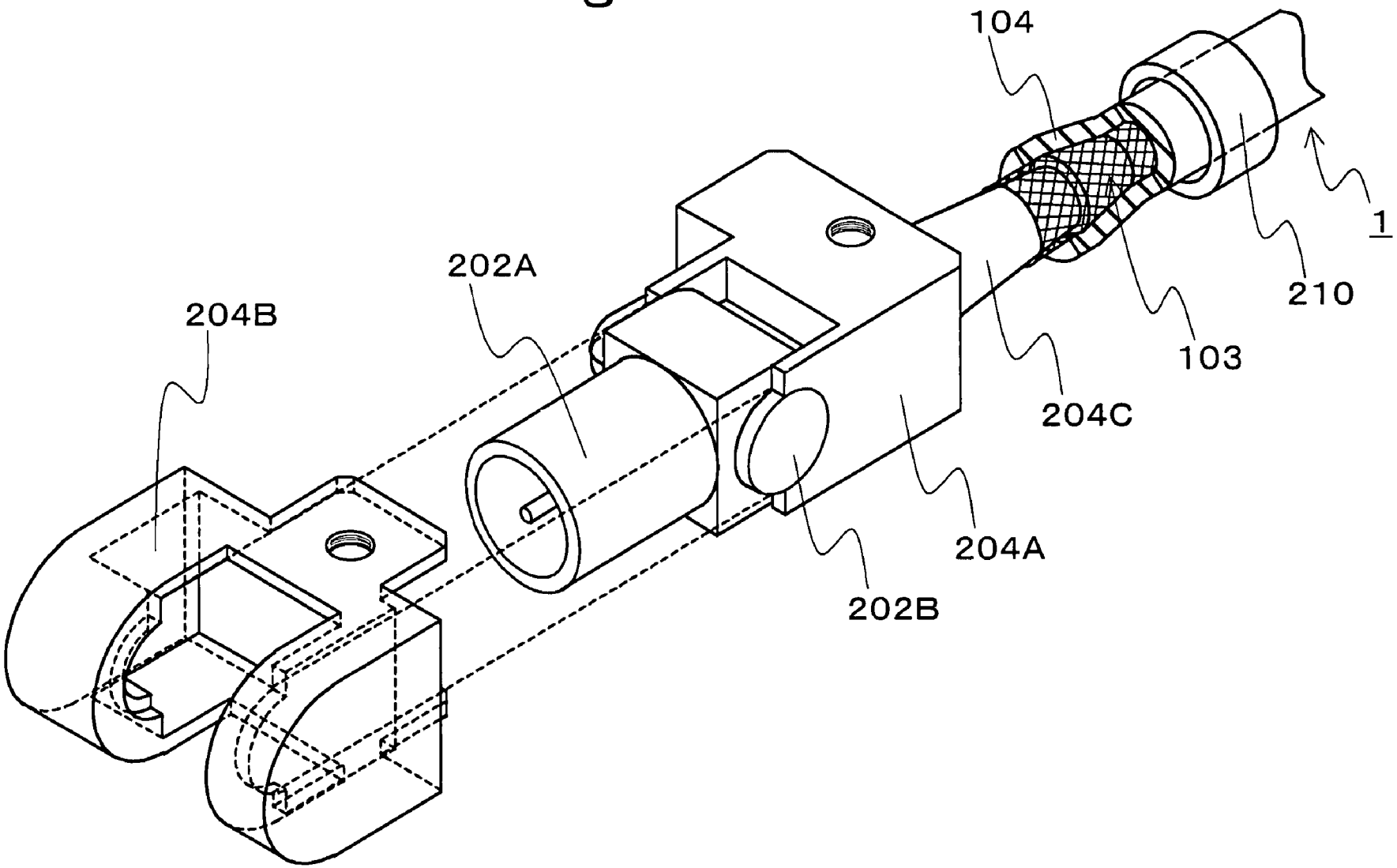
FIG. 20 is a schematic illustration to explain an assembly method of the coaxial cable with a plug of the third embodiment.
Figure 21:
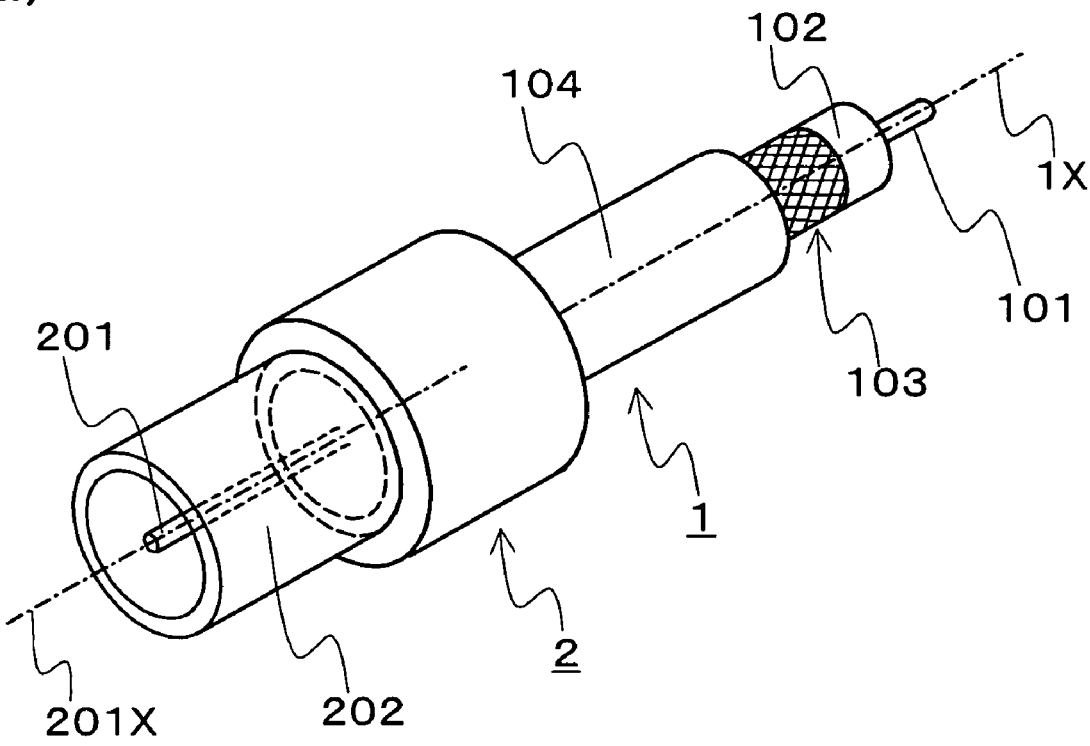
FIG. 21 is a schematic illustration to show a general structure of a conventional coaxial cable with a plug.
Figure 21:
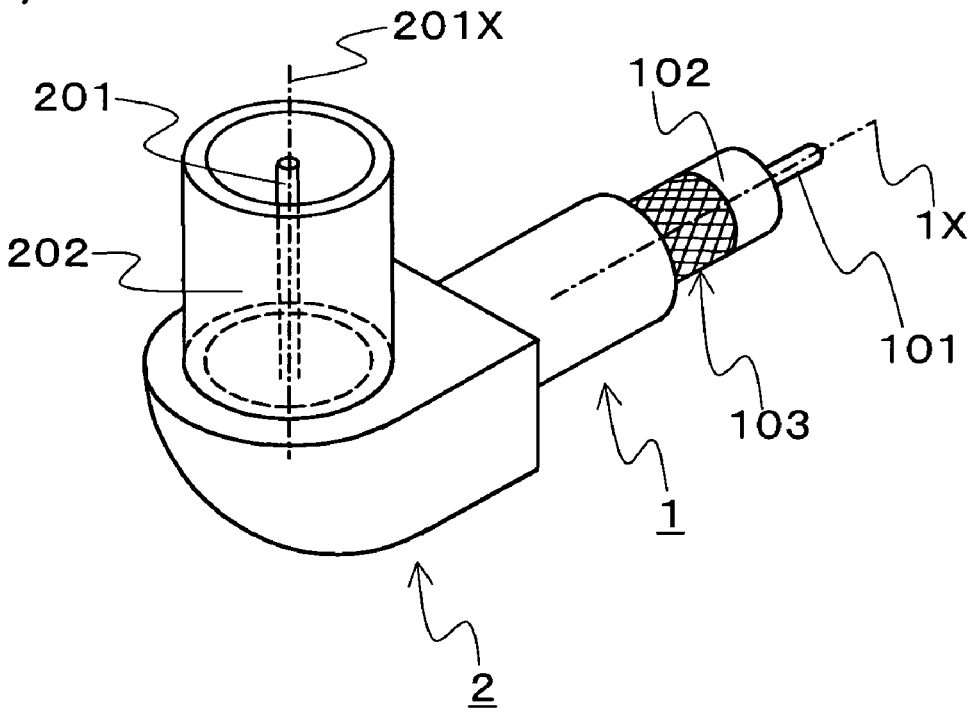

Next, as shown in FIG. 20, the first external conductor connecting member 204A is covered with a second external conductor connecting member 204B, and is fixed by screws and the like. At this time, since the central conductor 101 of the coaxial cable 1 and the central conductor connecting member 203 are not connected by soldering and the like, there is a risk of the coaxial cable 1 being pulled out. Hence, the connecting portion with the coaxial cable 1 and the pipe 204C of the first external conductor connecting member is caulked and fixed by the caulking ring 210.

As described above, according to the coaxial cable with a plug of the third embodiment, similarly to the coaxial cable with a plug of the first embodiment, the central contact and the external contact can be rotated. Hence, for example, the proper use of the conventional straight type and the right angle type can be made by one piece of the coaxial cable with a plug of the third embodiment, and a degree of freedom of adaptability to the application and the usage place can be enhanced.

INDUSTRIAL APPLICABILITY

As described above, the coaxial cable with a plug according to the present invention is useful as a cable which connects a television antenna or a television terminal of the wall face of a building and a television receiver, and is suitable to be used particularly in a place where surrounding circumstances of the terminal which connects the cable tend to change and a narrow place.

The invention claimed is:

1. A coaxial cable with a plug, comprising a coaxial cable and a plug connected to an end of the coaxial cable, said plug including:

a contact portion having a central contact generally in the form of a rod and an external contact generally in tubular form, the central contact and the external contact being disposed so as to form a coaxial structure; and a main body portion having a central conductor connecting member which electrically connects said central contact and a central conductor of said coaxial cable to each other, and an external conductor connecting member which electrically connects the external contact and an external conductor of said coaxial cable to each other, and wherein electrical connection between said central contact and said central conductor connecting member and electrical connection between said external contact and said external conductor connecting member are made in such a manner that said electrical connections are maintained when said contact portion is rotated, relative to said external conductor connecting member, on a rotation axis perpendicular to an axial direction of the central contact, and wherein when said contact portion is rotated on the rotation axis, the coaxial structure about the connection between said central contact and said central conductor connecting member is maintained before, after and during the rotation.

2. The coaxial cable with a plug according to claim 1, wherein said external contact has in an outer peripheral surface of a tubular conductor, a pair of projections which function as supporting points on which the rotation on the rotation axis is performed, one of the projections having a opening via which communication is provided between the outside and the inside of said tubular conductor at a position through which the rotation axis extends, and wherein a portion of said central contact connected to said central conductor connecting member is bent toward said projection having the opening, and said central contact is supported so that the bent portion coincides with the rotation axis.

3. The coaxial cable with a plug according to claim 1, wherein a portion of said external conductor connecting member connected to said external contact is constituted by two or more conductor parts, and wherein when the two or more conductor parts are combined, a pair of supporting and fixing portions to be engaged with a pair of projections of said external contact are formed.

* * * * *